United States Patent [19]

Fabregas

[11] 4,084,014

[45] Apr. 11, 1978

[54] PROCESS FOR SEALING ANODIC OXIDATION LAYERS ON ALUMINIUM SURFACES AND ITS ALLOYS

[76] Inventor: Juan Brugarolas Fabregas, 92, Via Layetana, Barcelona, Spain

[21] Appl. No.: 750,541

[22] Filed: Dec. 14, 1976

[30] Foreign Application Priority Data

Oct. 5, 1976 Spain ..... 452.499

[51] Int. Cl.[2] ..... C23D 11/24

[52] U.S. Cl. ..... 427/409; 148/6.16; 204/38 A

[58] Field of Search ..... 204/38 A, 35 N; 148/6.16, 6.27, 6.2; 427/409

[56] References Cited

U.S. PATENT DOCUMENTS

| | | | |
|---|---|---|---|
| 2,562,117 | 7/1951 | Osdal | 148/6.27 |
| 2,777,785 | 1/1957 | Schuster et al. | 148/6.2 |
| 3,094,435 | 6/1963 | Schuster et al. | 148/6.2 |
| 3,094,441 | 6/1963 | Curtin et al. | 148/6.16 |
| 3,175,964 | 3/1965 | Watanabe et al. | 148/6.16 X |
| 3,346,522 | 10/1967 | Schuster et al. | 148/6.2 X |

*Primary Examiner*—Ralph S. Kendall

*Attorney, Agent, or Firm*—Mark T. Basseches; Paula T. Basseches

[57] ABSTRACT

This invention relates to a process for sealing alumina layers formed on the surface of aluminum and its alloys by anodic oxidation, and to the composition for effecting such sealing. The process, which is preferably carried out at room temperatures for purposes of economy, comprises contacting said layer with an aqueous composition which includes phosphate ions, trivalent chromium, and an emulsified organic resin.

5 Claims, No Drawings

PROCESS FOR SEALING ANODIC OXIDATION LAYERS ON ALUMINIUM SURFACES AND ITS ALLOYS

The disclosure concerns a process for sealing alumina layers obtained by anodic oxidation of aluminium and its alloys, by means of a water-based composition, which is used at room temperature and in a minimum contact time. It can replace conventional sealing systems spending a prolonged immersion time in hot water.

Anodizing processes consist on the formation of a layer of alumina by anodic oxidation of the metal surface and followed by a sealing process of the porosities of the formed layer.

The mentioned porosity of the layer is useful for colouring the metal surface by means of certain dyestuff solutions. Final sealing of these porosities is absolutely necessary to improve corrosion resistance and metal appearance.

Conventional sealing processes consist on a hydratation of the alumina layer. Transformation of aluminium oxide ($Al_2O_3$) into aluminium hydrate ($Al_2O_3$ 3 $OH_2$) supposes an increase in volume of the oxide mass, which seals by itself the former porosities of the surface. Consequently, its absorption capacity is completely reduced and there is no possibility of dyeing. The hydratation of the oxide layer is accomplished by immersion in hot water for a period of time from 15 to 40 minutes, depending on the thickness of the alumina layer.

Conventional processes demand a considerable amount of time and energy to keep the bath temperature. Production rates per volume of bath are then very low, and consequently treatment costs become expensive.

A composition for the formation of coatings on bare metal having similarities to the composition used in connection with the method herein is described in U.S. Pat. No. 4,006,041.

The object of the present disclosure is a method to achieve complete sealing of surface porosities of the alumina layer, by means of a room temperature process and a minimum working time.

The system proposes the use of a water-based compound containing as principal ingredients, phosphate and trivalent chromium ions as well as an organic polymer. It is well-known the passivating effect of phosphate and trivalent chromium ions on aluminium surfaces, and using them in the proposed composition, they will penetrate into the cavities of anodized surfaces imparting to them a passivating effect and sealing the porosities. The organic polymer will form a continuous surface film, which will be water and corrosion resistant after drying.

Metallic ions such as Zn and Al, and/or polyvalent ions such as Mn, Co, Ni and Sn, are capable of minimizing the electrochemical reactions developed in corrosion phenomena. Also, hexavalent chromium confers a passivating action on aluminium surfaces.

The use of such compositions provides a comparable sealing to that obtained by conventional hot water systems. Typical sealing tests, such as dyestuff absorption, show no porosity of the treated piece (part). The sealing effect on anodized aluminium by this method is also demonstrated through microscope observation, giving a very similar image to that of conventional sealing and quite different from not sealed surfaces. On the other hand, corrosion resistances tests, Salt Spray method and humidity tests, show that a higher degree of protection is achieved as compared to traditional sealing processes. This is due to the additional passivating action of the proposed sealing treatment.

The new composition includes a primary chromium phosphate $(PO_4H_2)_3Cr$, solution into an organic resin emulsion, the final product being water soluble. The composition must be entirely solubilized in such a way that trivalent chromium salts are able to penetrate into porosities of the alumina layer, imparting to this its protective properties.

Primary chromium phosphates are obtained from the reaction between a trivalent chromium product, commonly $Cr(OH)_3$, and phosphoric acid. The ratio of phosphate ions (as $P_2O_5$) to trivalent chromium ions ($Cr^3$) not being inferior to 1 ($P_2O_5$/ $Cr^3$), in order to assure complete solubilization of chromium.

Another method to obtain trivalent chromium into a phosphoric acid solution, is by reduction in situ of an hexavalent chromium component, as, for example, $Cr_2O_7Na_2$, $CrO_3$ or $(SO_4)_4$ $K_2Cr_2$, by the action of a reducing agent. Among reducing agents, substances containing hydroxilic or aldehyd groups, such as mono or poly-alcohols or glycols, are prefered. The necessary quantity of hexavalent chromium will be the sufficient one to provide, after its reduction, an amount of trivalent chromium of 20 to 0.01 gr./lt., and preferently, of 15 to 0.1 gr. per liter. The quantity of reducing agent cannot be predetermined since it will depend upon its own composition, and consequently, dependant upon the number of hidroxilic group of the selected reducer and also the nature of the hexavalent chromium component used. It is most important that all reducing agent be consumed in the redox reaction.

As mentioned before, hexavalent chromium improves anticorrosion properties of deposited film. Hexavalent components can be added to the described treating solution. The quantity of hexavalent chromium (as $CrO_3$) in the composition solution will not be higher than 15 gr./l. Above this limitation, colouring of the metal surface may occur.

Other convenient ingredients to improve the sealing effect of the composition, are amphoteric ions Zn and Al, and/or polyvalent ions such as Mn, Co, Ni and Sn, in quantities not superior to 50 Gr./l. They can be additioned to the treating solution in the form of metallic compounds, specially its oxides and carbonates.

Organic polymers having a cross-linking character are prefered, because of its major water resistance. Acrylic, vinyl-acrylic and styrene-acrylic polymers and co-polymer emulsions, and specially those having a molecular weight superior to 100.000, have a satisfactory behaviour.

This kind of emulsion resins are commercially available in the market under trade marks like Primal resins from RHOM and HAAS, and Vinacryl resins from VINYL PRODUCTS.

It is of most importance that aqueous emulsion resins be stable in acidic pH media and in the presence of trivalent chromium ions. Emulsions or dispersions of non-ionic character are best in this respect. Solids content of emulsions should be from 40 to 60%. Mixtures fulfilling these required characteristics will stand without deterioration for long periods of time.

Several examples of the proposed sealing compositions are as follows:

EXAMPLE 1

50 grs. of commercial phosphoric acid (85%) are mixed with 1 gr. of chromium carbonate. After the reaction is completed, which is accelerated by heat, 70 grs. of acrylic resin emulsion Vinacryl are added. This solution is diluted to 1 liter with demineralized water.

EXAMPLE 2

2 grs. of Sodium Dichromat dissolved in 20 grs. of water, are added to 70 grs. of commercial phosphoric acid (85%). Afterwards, 1.5 gr. of ethylen glycol should be additioned, a redox reaction takes place and hexavalent chromium is converted into trivalent chromium, the colour of the solution becoming green. After reaction is accomplished, 50 grs. of acrylic resin Vinacryl are added. The solution is then diluted to 1 liter with demineralized water.

EXAMPLE 3

A composition prepared as in Example 2, in which the amount of sodium dichromate is 5 grs.

EXAMPLE 4

A composition prepared as in Examples 1, 2 or 3 in which 2 grs. of magnesium carbonate are added and preferently at the initial stage to react with phosphoric acid.

The application of the proposed sealing solutions will be carried out by spray methods or immersion bath at room temperature. The aluminium surface being previously anodized and eventually coloured. Contact time of metal surface with treating solution can be as short as production rate would demand. After an adequate draining, sealed pieces (parts) will be dried by conventional systems. The use of such compositions is adequate for conventional existing equipments.

I claim:

1. The method of sealing surface porosities of a surface layer of aluminum oxide formed by anodic oxidation on an article comprised of aluminum which comprises contacting said surface layer with an aqueous solution which includes phosphate ions, trivalent chromium ions, and an emulsion or dispersion or organic resin selected from the group consisting of polymers or co-polymers of acrylic, vinylacrylic and styrene-acrilic, and thereafter causing said surface layer to dry, said ingredients being present in substantially the following concentration ranges:

phosphate ions (expressed as $P_2O_5$) .5 to 150 grs./liter
trivalent chromium (expressed as $Cr_2O_3$) .01 to 20 grs/liter
resin (solids) 2 to 300 grs/liter.

2. The method in accordance with claim 1 wherein said solution comprises an aqueous solution and said contact between said solution and layer is effected at room temperature.

3. A method in accordance with claim 1 wherein the ingredients are present in substantially the following concentration ranges:

phosphate ions (expressed as $P_2O_5$) 5 to 100 grs/liter
trivalent chromium (expressed as $Cr_2O_3$) .1 to 15 grs/liter
resin (solids) 5 to 100 grs/liter.

4. The method in accordance with claim 1 wherein said solution includes amphoteric ions selected from the group consisting of zinc and aluminum in concentrations of up to about 50 grams per liter.

5. The method in accordance with claim 1 wherein said solution includes polyvalent ions selected from the group consisting of manganese, nickel, cobalt and tin in concentrations of up to about 50 grams per liter.

* * * * *